US011959266B2

(12) United States Patent
Russell

(10) Patent No.: US 11,959,266 B2
(45) Date of Patent: Apr. 16, 2024

(54) HANDS-FREE FLUSHING DEVICE

(71) Applicant: Brandon Russell, Lima, NY (US)

(72) Inventor: Brandon Russell, Lima, NY (US)

( * ) Notice: Subject to any disclaimer, the term of this patent is extended or adjusted under 35 U.S.C. 154(b) by 0 days.

(21) Appl. No.: 17/193,846

(22) Filed: Mar. 5, 2021

(65) Prior Publication Data

US 2023/0366185 A1 Nov. 16, 2023

(51) Int. Cl.
*E03D 5/08* (2006.01)

(52) U.S. Cl.
CPC ..... *E03D 5/08* (2013.01)

(58) Field of Classification Search
CPC ... A47K 13/10–105; E03C 1/052; E03D 5/02; E03D 5/028; E03D 5/08; E03D 5/09–094
USPC ..... 4/249
See application file for complete search history.

(56) References Cited

U.S. PATENT DOCUMENTS 3,883,904 A * 5/1975 Wittman ..... E03D 5/08 251/295
5,068,925 A * 12/1991 Salibi ..... E03D 5/08 4/405
5,142,708 A * 9/1992 Johnson ..... E03D 5/08 4/249
5,170,513 A * 12/1992 Ambooken ..... E03D 5/08 251/295
5,802,626 A * 9/1998 Bedana ..... E03D 5/08 4/308
9,151,031 B1 * 10/2015 Roby ..... E03D 5/08

FOREIGN PATENT DOCUMENTS

KR 20130072361 * 7/2013 ..... E03D 5/08

* cited by examiner

*Primary Examiner* — David P Angwin
*Assistant Examiner* — Nicholas A Ros
(74) *Attorney, Agent, or Firm* — Christopher B. McKinley

(57) ABSTRACT

A hands-free flushing device and method of using same to allow a user to flush a toilet with their foot instead of their hands, thereby avoiding the spread of germs and bacteria. The hands-free flushing device is removably attached to the toilet flush handle of an existing toilet with little to no modification, allowing for easy installation. An embodiment of the hands-free flushing device comprises a foot pedal configured to suspend above the floor which allows for easy cleaning and avoids of the transmission of germs and bacteria.

15 Claims, 4 Drawing Sheets

HANDS-FREE FLUSHING DEVICE

BACKGROUND OF THE INVENTION

The present invention relates generally to the field of toilet flush devices and more specifically relates to a hands-free toilet flushing system.

Flush toilets are used in most homes and public restrooms. A flush toilet disposes of human waste by using water to flush the waste through a drainpipe, transferring it to another location for disposal. Most flush toilets have a toilet flush handle or lever, which is activated with a user's hand. Once activated, the toilet flush handle initiates the flushing process.

Public and private restrooms are rife with germs and bacteria. Even a seemingly spotless restroom contains lingering bacteria, which elevates a user's risk of bacterial transmission. Direct contact with germ- or bacteria-laden surfaces increases the risk of transmission to a user. Many users would therefore prefer to not directly contact the toilet flush handle to avoid germ or bacteria transmission from previous users or those otherwise present in the ambient environment. Hands-free flushing systems greatly decrease the possibility of germ and bacteria transmission from a toilet handle.

Hands-free flushing systems are well known, but existing systems have several drawbacks. Some hands-free flushing systems comprise an automatic sensor which senses the movement of a nearby user and attempts to automatically flush the toilet at the appropriate time, ideally when the user finishes using the toilet. There are, however, common issues with sensor flushing toilets. First, the sensors are easily corroded due to humidity in bathrooms and the likelihood of frequent contact with water from the toilet bowl. Second, the sensors tend to waste water by flushing at the inappropriate time, flushing the toilet upon any movement of the user during use. When this occurs, the toilet flushes unnecessarily, wasting water. Third, sensor flush devices are more expensive than, and require more complex manufacture and installation than, ordinary flush-handle toilets. Finally, there are limited ways to convert an ordinary flush-handle toilet to a sensor-operated one, limiting the utility of the system.

Other hands-free flushing systems include foot pedal linkages that are attached to the flush handle and also rest on or are anchored to the floor. These devices operate by allowing a user to depress the linkage with their foot, drawing the flush handle downward, thereby flushing the toilet. The linkages are anchored to the ground to prevent the weight of the linkage from pulling the handle down, inadvertently causing the toilet to flush or opening the flush valve (which would cause water to run indefinitely).

These hands-free flushing systems are problematic because they are hard to clean, prone to collecting bacteria and germs, and are difficult to install and/or replace. For instance, when the foot pedal is attached to the floor, dirt, grime, bacteria, and germs can build up on the pedal. Cleaning the pedal is made difficult because portions of the pedal that are anchored to the floor or the mounting unit is inaccessible for cleaning, absent removal from their fixed positions. In contrast, by raising the foot pedal off the floor, the system and foot pedal are easier to clean because the entire foot pedal is readily accessible. Such enhanced cleaning results in cleaner private bathrooms or public restrooms due to decreased bacteria- or germ-transmission. Floor-anchored foot pedal linkage systems also have the problem of requiring complicated and/or permanent installation. This can be time-consuming, expensive, and require specialized installation skills.

What is needed is a hands-free flushing system that solves the aforementioned problems.

BRIEF SUMMARY OF THE INVENTION

In view of the foregoing disadvantages, the present disclosure provides a novel hands-free flushing device for use with a typical toilet having a typical toilet flush handle or lever. As will be explained, the hands-free flushing device disclosed herein attaches a foot pedal linkage to a toilet flush handle of an ordinary flush toilet, allowing for easy installation and/or replacement and broad utility in various conditions. The linkage is of a length that allows the foot pedal to be suspended above the ground upon which the toilet is mounted. Further, the hands-free flushing device disclosed herein does not impede the function of the existing toilet flush handle, which can still be utilized if desired. Ideally, a hands-free flushing system should provide a low-cost, convenient, easy-to-install, and reliable solution to avoid the transfer of bacteria and germs when flushing a toilet in a private or public restroom. The general purpose of the present disclosure, which will be described in greater detail below, is to provide a low cost and convenient hands-free flushing device which can be adapted for use on any existing toilet.

Embodiments of the present disclosure may comprise a hands-free flushing device which may include a foot pedal having a bottom end and a top end, an extender having a bottom end and a top end, a first connecting member removably attached to the top end of the foot pedal and the bottom end of the extender, and a second connecting member removably attached to the top end of the extender and configured to be attached to a toilet flush handle of a toilet wherein said extender is configured to allow the foot pedal to be elevated from a floor during operation.

In another embodiment, a hands-free flushing system comprises a toilet having a hand-operated toilet flush handle, and a foot pedal linkage assembly comprising a foot pedal having a bottom end and a top end, an extender having a bottom end and a top end, a first connecting member removably attached to the top end of the foot pedal and the bottom end of the extender, and a second connecting member removably attached to the top end of the extender and the toilet flush handle of the toilet wherein said extender is of sufficient length to allow said foot pedal to be suspended from the floor.

The present disclosure further provides a method of using a hands-free flushing device, wherein the hands-free flushing device includes a foot pedal having a bottom end and a top end, an extender having a bottom end and a top end, a first connecting member removably attached to the top end of the foot pedal and the bottom end of the extender, and a second connecting member removably attached to the top end of the extender and configured to be attached to a toilet flush handle of a toilet wherein said extender is configured to allow the foot pedal to be elevated from a floor during operation. The method comprising the steps of placing a user's foot on the foot pedal of the hands-free flushing device and depressing the foot pedal downward to activate the existing toilet flush handle of the toilet.

The disclosed embodiments may also include a hands-free flushing device comprised of lightweight materials, allowing normal operation of the toilet flush handle. Ideally, the hands-free flushing device is lightweight, allowing the foot pedal to be positioned at an elevation from the floor upon which the toilet is fixed without putting excessive weight on the existing toilet flush handle. These features prevent the toilet from running due to undesirable actuation of the toilet flush handle due to the weight of the hands-free flushing device.

In another embodiment, the extender comprises a cord which is made of flexible material allowing the device to be stretched and/or moved into the ideal position for each particular use of the device.

In certain embodiments, the device can be installed on the toilet flush handle of an existing toilet with minimal installation and without requiring the removal or of replacement of any existing toilet parts. Ideally, the device will be installed to the existing toilet flush handle with little to no modifications, allowing the existing toilet flush handle to be utilized by a user if desired, and allowing for broad utility in varying conditions.

A better understanding of the invention will be provided by reference to the following description and claims, taken in conjunction with the attached drawings.

BRIEF DESCRIPTION OF THE FIGURES

The accompanying drawings, which are incorporated herein as part of this specification illustrate embodiments of the disclosure, and together with the general and detailed descriptions herein provided, serve to explain and illustrate features of the disclosure.

References to the following drawings are in no way limiting and are for illustrative purposes only.

DETAILED DESCRIPTION OF THE INVENTION

The below disclosure describes a hands-free flushing device. In the following disclosure, for the purposes of explanation and illustration, numerous details are set forth. It will be evident to a person of ordinary skill in the art, however, that the exemplary embodiments disclosed herein are illustrative only and are in no way limiting or restrictive.

As discussed above, embodiments of the present disclosure relate to a hands-free flushing device and method, and more particularly to a hands-free flushing system suspended from the floor to avoid the spread of bacteria and germs. The hands-free flushing device is easily installed and removably attached to provide a simple, efficient, and convenient system.

According to the present disclosure, a hands-free flushing system is a device disclosed herein which can be installed on an existing toilet flush handle to transform the existing toilet flush handle from a hand operated flush handle to an optional foot-operated flush handle, allowing hands-free flushing for limiting the spread of bacteria, germs, and pathogens.

Figure 1:
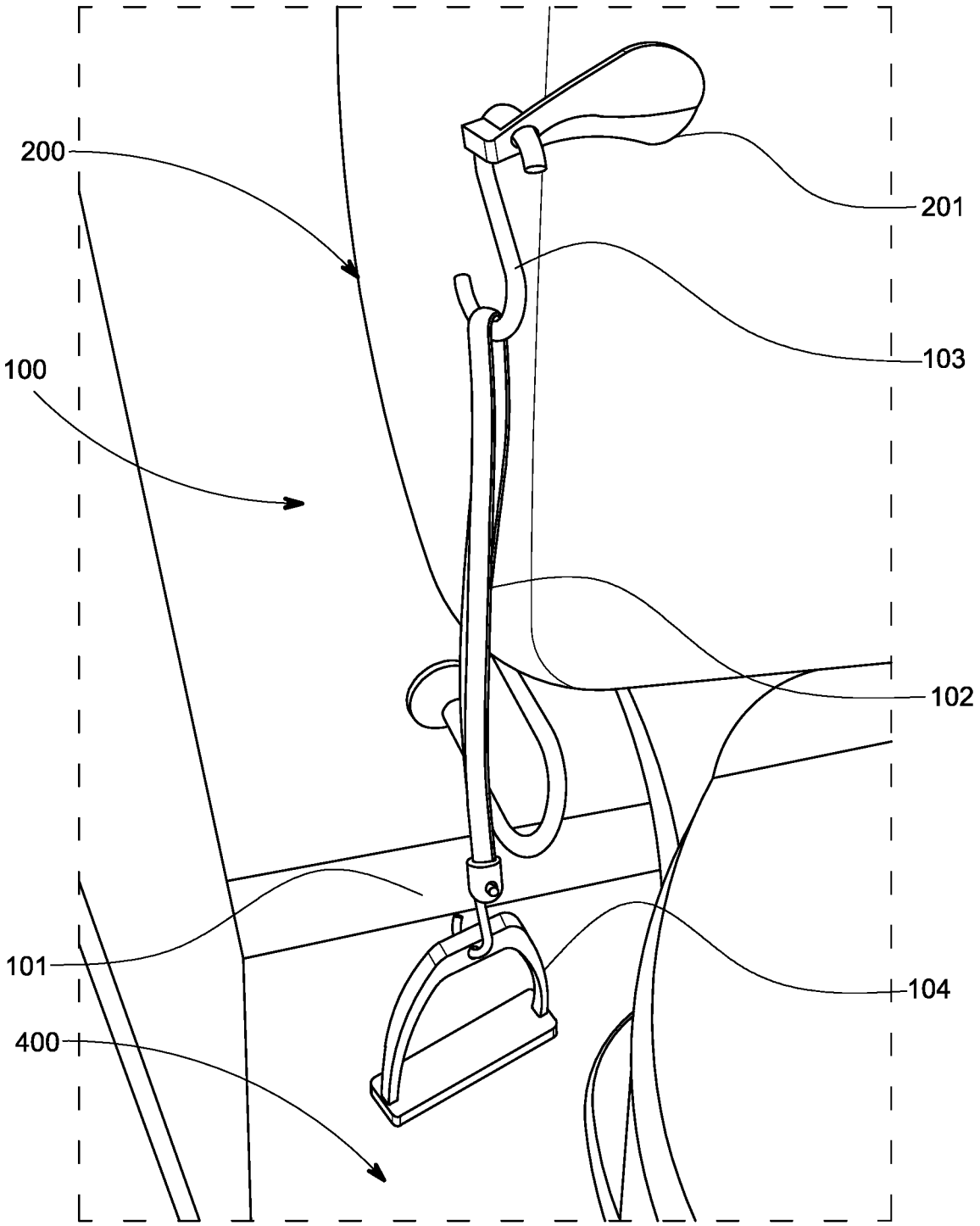
FIG. 1 is a perspective view of the hands-free flushing system.

FIG. 1 illustrates an exemplary embodiment of a hands-free flushing device 100 attached to a typical toilet 200 commonly found in public and private restrooms. The toilet 200 is mounted to a floor 400 and has a toilet flush handle 201 attached to it. The hands-free flushing device 100 is removably attached to the toilet flush handle 201 of the toilet 200. The hands-free flushing device 100 comprises linkage assembly that includes a first connecting member 101, an extender 102, a second connecting member 103, and a foot pedal 104. The first connecting member 101 is removably attached to a lower end of the extender 102 and a top end of foot pedal 104. The second connecting member 103 is attached to an upper end of the extender 102 and configured to be removably attached to the toilet flush handle 201 of the toilet 200.

In one embodiment, as shown in FIG. 1, the first connecting member 101 and the second connecting member 103 have an S-shape. Opposing ends of the S are received within openings in the respective members: e.g., the extender 102, the foot pedal 104, or the toilet flush handle 201. Thus, in some embodiments, installation of the hands-free flushing device 100 requires modifying an otherwise solid toilet flush handle 201 by drilling a hole in it to create an opening for receiving an end of the second connecting member 103. Alternatively, the toilet flush handle can be manufactured with an opening to receive an end of the second connecting member 103. In another embodiment, not shown, the first and second connecting members 101 and 103 may include different attachment means, such as, for example, elastic bands, threaded connectors, male-female connectors, snap-fit connectors, hook and loop fasteners, adhesive, or the like. A skilled artisan would understand that the attachment means for securing the first and second connecting members 101 and 103 to the extender 102, the foot pedal 104, and the toilet flush handle 201 can assume varying forms for a given application in keeping with the present disclosure.

In one embodiment, as shown in FIG. 1, the extender 102 is comprised of a flexible material, such as a cord. The extender 102 may also be comprised of flexible, lightweight materials such as rubber, latex, synthetic fabrics, or the like. In other embodiments, the extender 102 may be comprised of rigid or non-flexible material, such as, for example, metal or thermoplastics comprising polyethylene terephthalate (PET), high density polyethylene (HDPE), poly-vinyl chloride (PVC), and polypropylene (PP), or the like. In one embodiment, as shown in FIG. 1, the extender 102 may be relatively thin in width, but its shape and form can vary depending on a given application. The material, shape, and size of the extender 102 is configured to allow the hands-free flushing device 100 to be suspended from the toilet flush handle 201. This suspended configuration provides a more sanitary solution than known hands-free devices that are anchored to the floor because all of its surfaces can be readily accessed and cleaned. The suspended configuration also allows for easy installation and replacement as attachment to the floor is not required. And given that the hands-free flushing device 100 is formed from lightweight material, its weight does not tend to bias the toilet flush handle 201 downward, so as to cause inadvertent flushing or unsealing of the flush valve. Furthermore, as shown in FIG. 1, the lower end of the extender may optionally be reinforced with, for example, an increased thickness to provide added strength and resist tearing near the opening. A skilled artisan would understand that the extender 102 for connecting the foot pedal 104 with the toilet flush handle 201 can utilize varying materials in varying forms for a given application in keeping with the present disclosure.

Figure 2:
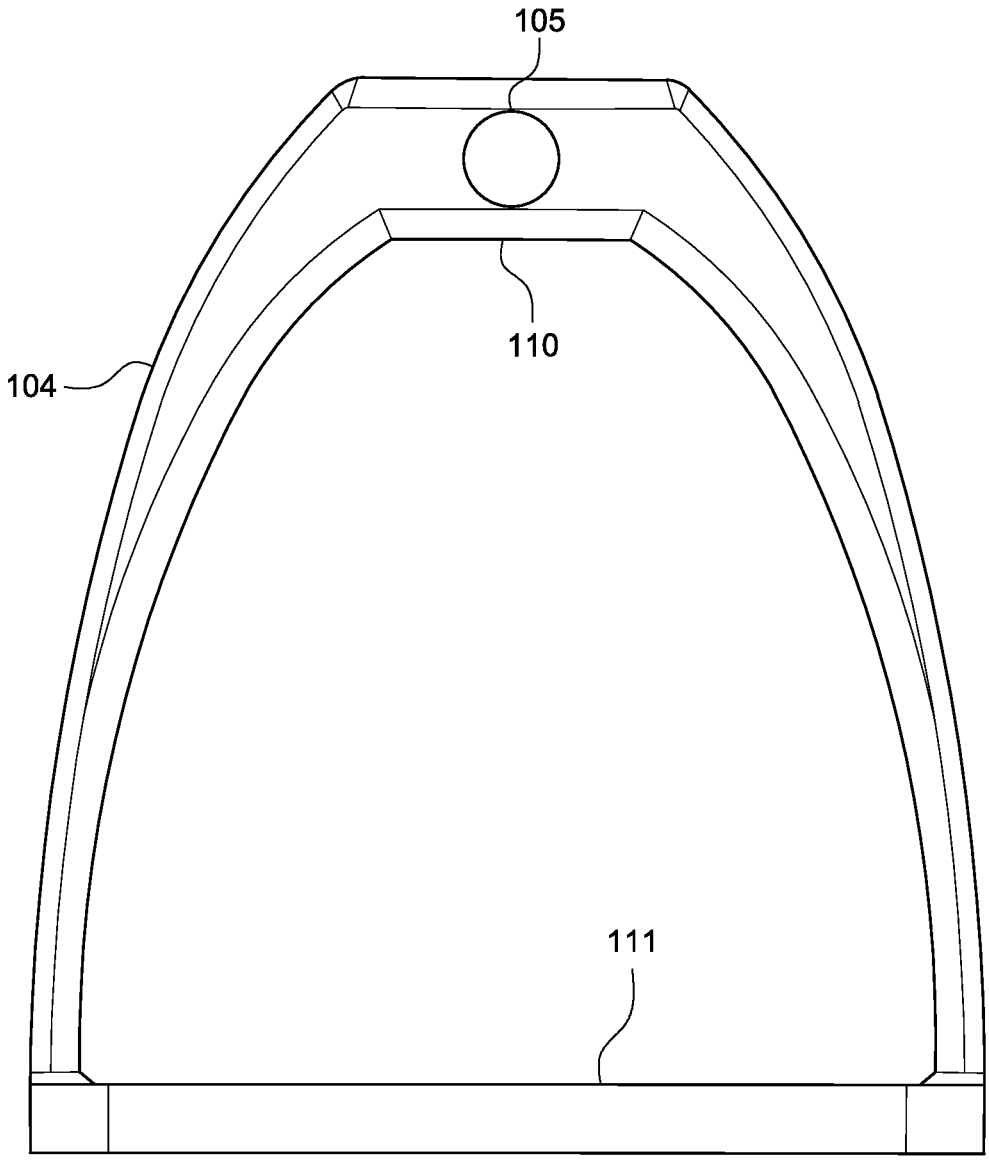
FIG. 2 is a front view of the foot pedal portion of the hands-free flushing system.

FIG. 2 illustrates a front view of an exemplary embodiment of a foot pedal 104. The foot pedal 104 consists of a top end 110 and a bottom end 111. The top end 110 of the foot pedal 104 has an opening 105 that is configured to allow a connection to the bottom end of the extender 102 via the first connecting member 101. The bottom end 111 is configured to receive a user's foot, withstand the stress imposed on it when a downward force is applied thereto, and accommodate varying shoe shapes and sizes. As explained, the foot pedal 104 is comprised of lightweight materials such that the foot pedal 104 is suspended from the ground without putting undue pressure on the existing toilet flush handle 201. The foot pedal 104 in FIG. 1 is shown having an arcuate or semi-circled shape, but, in some embodiments, the foot pedal is rectangular, square, elliptical, trapezoidal, or circular. A person of skill in the art would understand that the shape of the foot pedal can vary in keeping with the present disclosure.

In one embodiment, the foot pedal 104 is comprised of rigid, non-flexible material, such as, for example metal or thermoplastics comprising polyethylene terephthalate (PET), high density polyethylene (HDPE), poly-vinyl chloride (PVC), and polypropylene (PP), or the like. In others the foot pedal 104 may be comprised of flexible, light weight material, such as, for example, rubber, latex, synthetic fabric, or the like. In one embodiment, as shown in FIG. 1, the foot pedal 104 is in the shape of a semi-circle.

Figure 3:
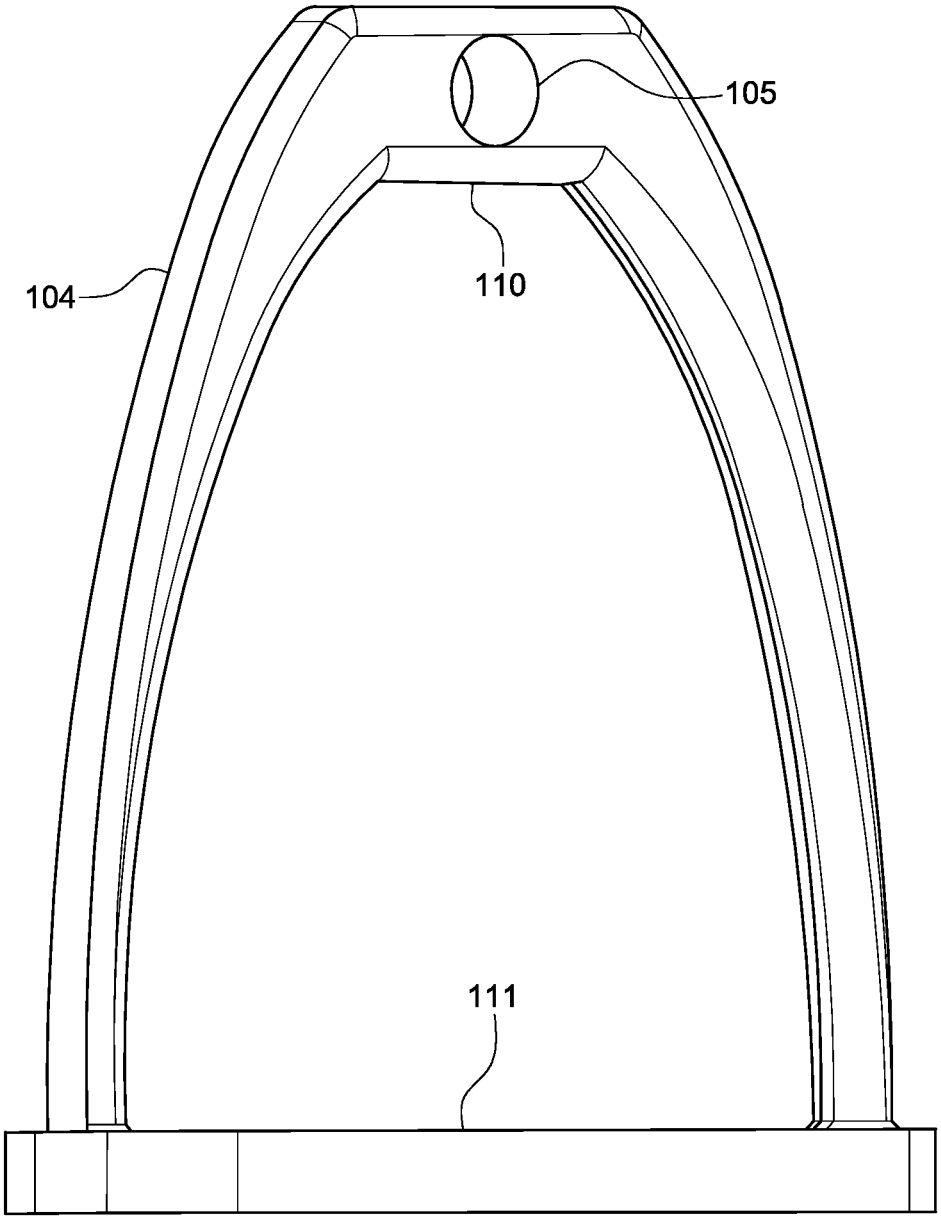
FIG. 3 is a perspective view of the foot pedal portion of the hands-free flushing system.
Figure 4:
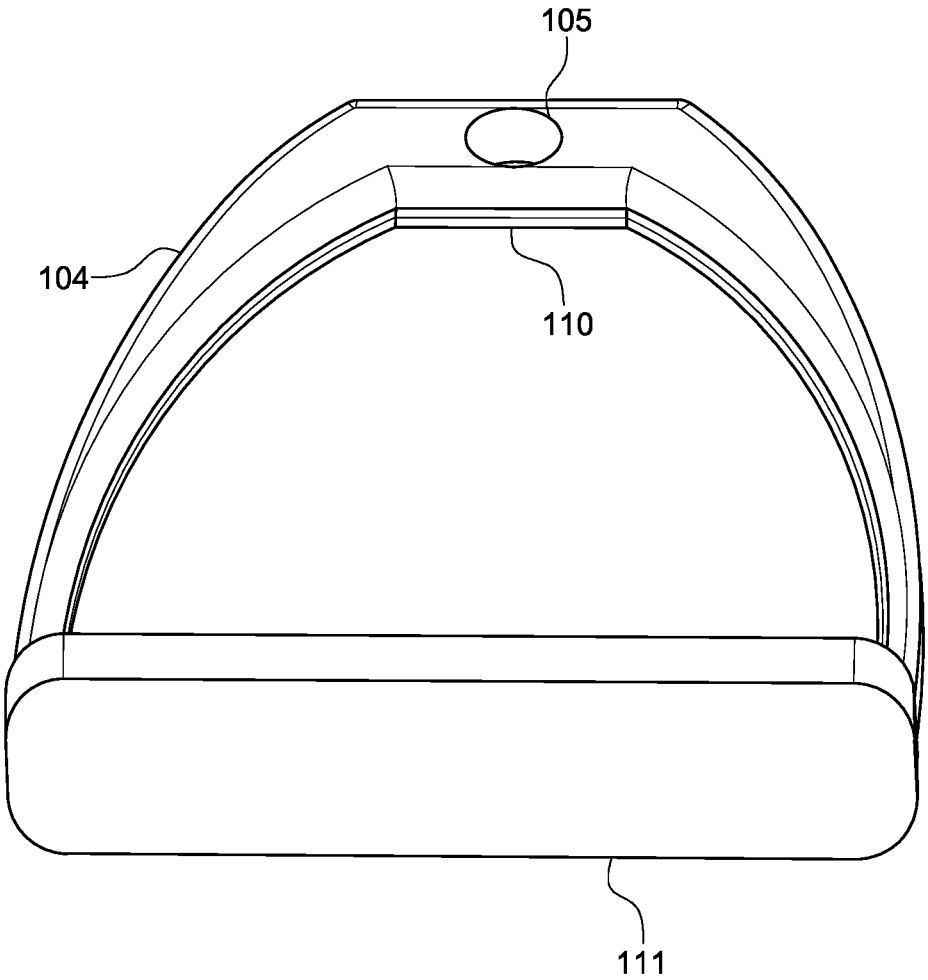
FIG. 4 is a another perspective view of the foot pedal portion of the hands-free flushing system.

FIG. 3 and FIG. 4 illustrate differing views of an embodiment of the foot pedal 104. FIG. 3 illustrates a side perspective view of an exemplary embodiment of a foot pedal 104. FIG. 4 illustrates a bottom perspective view of an exemplary embodiment of a foot pedal 104. In operation, when a user presses downward on the bottom end 111 of the suspended foot pedal 104 with their foot, the toilet flush handle 201 is engaged, actuating the toiler flushing mechanism and causing the toilet to flush.

This disclosure is to be regarded as illustrative rather than restrictive. Although the inventive material in this disclosure has been described in detail along with some of its technical advantages, it will be understood that various changes, substitutions, and alterations may be made to the detailed embodiments without departing from the broader spirit and scope of the disclosure as set forth in the following claims. It is further understood that the above description is intended to be illustrative, and neither restrictive or limiting. Many other embodiments will be apparent to those of ordinary skill in the art upon reading and understanding the above description. Although the present disclosure has been described with reference to specific embodiments, it is noted that the disclosure is not limited to the embodiments described or depicted herein. Rather, embodiments of the disclosure can be practiced with modification and alteration not herein mentioned, but otherwise within the spirit and scope of the claims herein provided.

What is claimed is:

1. A hands-free flushing device for a toilet comprising:
a foot pedal having:
a bottom end and a top end;
an extender having:
a bottom end and a top end;
a first connecting member removably attached to the top end of the foot pedal and the bottom end of the extender;
a second connecting member removably attached to the top end of the extender and configured to be attached to a toilet flush handle of the toilet;
wherein said extender has a length that allows the foot pedal to be positioned above a floor upon which the toilet is fixed such that the hands-free flushing device does not contact the floor during use; and
wherein the hands-free flushing device has a weight that allows it to be suspended from the toilet flush handle at a distance from the floor without causing the toilet flush handle to flush the toilet,
wherein the extender comprises a cord made of flexible material.

2. The hands-free flushing device of claim 1, wherein the flexible material comprises rubber, latex, synthetic fabrics, or a combination thereof.

3. The hands-free flushing device of claim 1, wherein the first and second connecting members comprise elastic bands, threaded connectors, male-female connectors, snap-fit connectors, hook and loop fasteners, or adhesive, or a combination thereof.

4. The hands-free flushing device of claim 1, wherein the first and second connecting members comprise an S-hook.

5. The hands-free flushing device of claim 4, wherein the top end of the foot pedal has an opening configured to receive an end of the first connecting member.

6. A hands-free flushing system for a toilet comprising:
a toilet having:
a hand-operated toilet flush handle; and
a hands-free flushing device, the hands-free flushing device comprising:
a foot pedal having a bottom end and a top end;
an extender having a bottom end and a top end;
a first connecting member removably attached to the top end of the foot pedal and the bottom end of the extender;
a second connecting member removably attached to the top end of the extender and configured to be attached to a toilet flush handle of the toilet;
wherein said extender has a length that allows the foot pedal to be positioned above the floor upon which the toilet is fixed such that the hands-free flushing device does not contact the floor during use; and
wherein the hands-free flushing device has a weight that allows it to be suspended from the toilet flush handle at a distance from the floor without causing the toilet flush handle to flush the toilet,
wherein the extender comprises a cord made of flexible material.

7. The hands-free flushing system of claim 6, wherein the flexible material comprises rubber, latex, synthetic fabrics, or a combination thereof.

8. The hands-free flushing system of claim 6, wherein the first and second connecting members comprise elastic bands, threaded connectors, male-female connectors, snap-fit connectors, hook and loop fasteners, or adhesive, or a combination thereof.

9. The hands-free flushing system of claim 6, wherein the first and second connecting members comprise an S-hook.

10. The hands-free flushing system of claim 9, wherein the top end of the foot pedal has an opening configured to receive an end of the first connecting member.

11. A method of using a hands-free flushing device, wherein the hands-free flushing device comprises a foot pedal having a bottom end and a top end, an extender having a bottom end and a top end, a first connecting member removably attached to the top end of the foot pedal and the bottom end of the extender, a second connecting member removably attached to the top end of the extender and configured to be attached to a toilet flush handle of the toilet, wherein said extender has a length that allows the foot pedal to be positioned above a floor upon which the toilet is fixed such that the hands-free flushing device does not contact the floor during use, and wherein the hands-free flushing device has a weight that allows it to be suspended from the toilet flush handle at a distance from the floor without causing the toilet flush handle to flush the toilet the method comprising the steps of:

placing a foot onto the foot pedal;

depressing the foot pedal downward to activate the toilet flush handle of the toilet; and wherein the foot pedal remains suspended from the floor when depressed, wherein the extender comprises a cord made of flexible material.

12. The method of using the hands-free flushing device of claim 11, wherein the flexible material comprises rubber, latex, synthetic fabrics, or a combination thereof.

13. The method of using the hands-free flushing device of claim 11, wherein the first and second connecting members comprise elastic bands, threaded connectors, male-female connectors, snap-fit connectors, hook and loop fasteners, or adhesive, or a combination thereof.

14. The method of using the hands-free flushing device of claim 11, wherein the first and second connecting members comprise an S-hook.

15. The method of using the hands-free flushing device of claim 14, wherein the top end of the foot pedal has an opening configured to receive an end of the first connecting member.

* * * * *